United States Patent [19]

Hill

[11] Patent Number: 4,671,302

[45] Date of Patent: Jun. 9, 1987

[54] HAIR CLAMP

[75] Inventor: Percy H. Hill, Silver Lake, N.H.

[73] Assignee: Stratford Laboratories, Englewood Cliffs, N.J.

[21] Appl. No.: 802,419

[22] Filed: Nov. 27, 1985

[51] Int. Cl.[4] ..... A45D 8/00

[52] U.S. Cl. ..... 132/9; 132/7; 132/48 R; 132/48 A

[58] Field of Search ..... 132/46 R, 46 A, 48 R, 132/48 A, 38 R, 7, 9, 41 R

[56] References Cited

U.S. PATENT DOCUMENTS

| | | | |
|---|---|---|---|
| 2,299,017 | 10/1942 | Hoffman | 132/9 |
| 3,419,017 | 12/1968 | Soloman et al. | 132/7 |
| 3,662,767 | 5/1972 | Murtha | 132/9 |
| 4,403,622 | 9/1983 | Stahl | 132/7 |

*Primary Examiner*—John J. Wilson
*Assistant Examiner*—Adriene J. Lepiane
*Attorney, Agent, or Firm*—Norman E. Lehrer

[57] ABSTRACT

A hair clamp has an outer shell comprised of a substantially rigid sheet-like material such as cardboard or the like. The surfaces of the cardboard are preferably coated with a water-repellent material. The inner surface of the shell is also covered with a quarter-inch layer of foam material. The shell and the foam liner are then folded over upon themselves along a midportion thereof to form a clamp having front and back halves with the foam liner in the inside thereof. A U-shaped plastic clamp or a plastic coated wire twist device can be used to maintain the hair clamp in its closed position. The outer configuration of the hair clamp is substantially rectangular. However, the bottom of the device is somewhat concavely curved while the top is convexly curved. This allows the device to be placed close to the person's head since the bottom fits the contour of the head. The hair clamps can also be stacked vertically one on top of the other for longer hair.

9 Claims, 4 Drawing Figures

HAIR CLAMP

BACKGROUND OF THE INVENTION

The present invention is directed toward a hair clamping device and more particularly toward such a device which is intended to hold a hank of hair being straightened or otherwise treated and which is extremely simple to utilize and easily and cheaply manufactured so that the same can be made to be disposable.

While the clamp of the present invention may be used for various types of hair treatments such as tinting, frosting, selective coloring, streaking, etc., it is particularly useful for straightening curly hair. Devices for straightening curly hair have been known for some time. Many prior art devices such as shown in U.S. Pat. Nos. 1,432,251; 1,986,689 and 2,419,117 utilize electric heating means to accomplish the straightening. While such devices may be somewhat effective in straightening the hair, they can also cause extensive damage to the hair because of the temperature and duration of the heat which must be applied in order to be effective. Furthermore, the cost of these devices is relatively high.

Other devices for use with chemical straightening of hair have also been proposed. Examples of these devices are shown in U.S. Pat. Nos. 2,955,604; 3,343,548 and 3,367,345. Insofar as Applicant can determine, the device shown in the first of these patents cannot be effective since means are not provided for maintaining the hair in a straight or tensioned condition during use. The latter two patents are useful only for straightening the portions of the hair adjacent the scalp. These devices cannot be used for straightening the entire length of the person's hair.

Insofar as Applicant is aware, there are no devices presently on the market nor have there ever been any proposed which are capable of easily and effectively straightening a person's hair in a safe manner. All prior devices have also been relatively expensive. They are normally not intended for single use but must be cleaned and sterilized for subsequent use.

A wide variety of devices are also disclosed in the prior art for use in tinting or coloring hair. These are shown, for example, in U.S. Pat. Nos. 2,299,017; 2,299,018; 2,962,031 and 3,101,724. Such devices, however, are useful only for coloring or tinting and cannot be used for other purposes such as for straightening.

There is one prior art device which has been proposed specifically for use in dyeing hair at the roots but which could be used in a hair straightening process although there has been no previous suggestion for using the device in that manner. This device is shown in U.S. Pat. No. 3,662,767. The device of that patent is a box or cylindrical shaped hinged shell which carries a foam pad therein. The device is clamped around a hank of hair and is held in a closed position by a clasp mounted thereon. Because of the shape of these patented devices, only a limited number of them can be applied to a person's hair since they would otherwise interfere with each other. Furthermore, because of the shape of the ends of the devices, they cannot be placed too close to a person's head.

SUMMARY OF THE INVENTION

The present invention is designed to overcome all of the defects of the prior art discussed above and provides a universal hair clamp device which has various uses but which is particularly useful for straightening hair.

The clamp is easy and safe to utilize and is extremely inexpensive so that it can be used once and then disposed of. The device is in the form of a clamp having an outer shell comprised of a substantially rigid sheet-like material such as cardboard or the like. The surfaces of the cardboard are preferably coated with a water-repellent material. The inner surface of the shell is also covered with a quarter-inch layer of foam material. The shell and the foam liner are then folded over upon themselves along a midportion thereof to form a clamp having front and back halves with the foam liner in the inside thereof. A U-shaped plastic clamp or a plastic coated wire twist device can be used to maintain the hair clamp in its closed position. The outer configuration of the hair clamp is substantially rectangular. However, the bottom of the device is somewhat concavely curved while the top is convexly curved. This allows the device to be placed close to the person's head since the bottom fits the contour of the head. The hair clamps can also be stacked vertically one on top of the other for longer hair.

BRIEF DESCRIPTION OF THE DRAWINGS

For the purpose of illustrating the invention, there are shown in the accompanying drawings forms which are presently preferred; it being understood that the invention is not intended to be limited to the precise arrangements and instrumentalities shown.

DETAILED DESCRIPTION OF THE PREFERRED EMBODIMENTS

Figure 1:
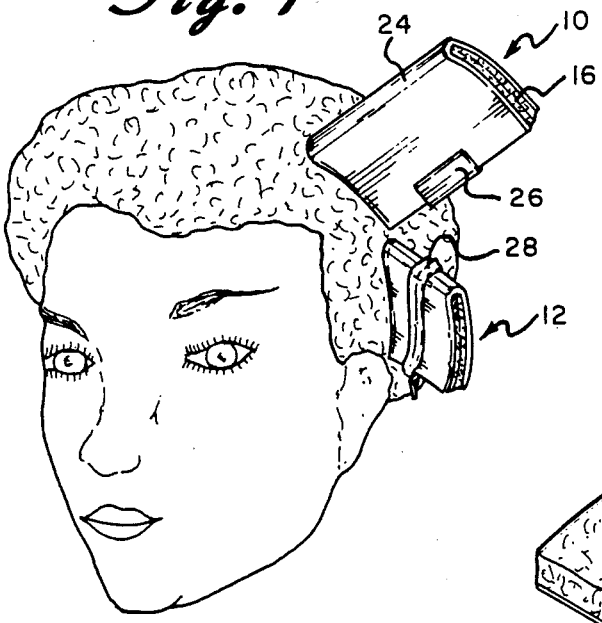
FIG. 1 is a schematic representation showing the manner in which hair clamps constructed in accordance with the principles of the present invention are applied to a person's hair.

Referring now to the drawings in detail wherein like reference numerals have been used throughout the various figures to designate like elements, there are shown in the figures hair clamps constructed in accordance with the principles of the present invention and designated generally as 10 and 12. As will become apparent hereinafter, hair clamps 10 and 12 are substantially identical to each other and differ only in the specific mechanism for closing the same.

Figure 3:
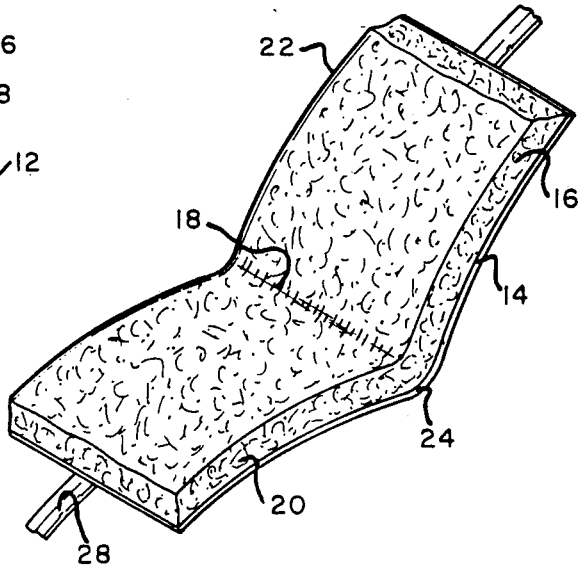
FIG. 3 is a perspective view of a hair clamp shown in its open form before use.
Figure 4:
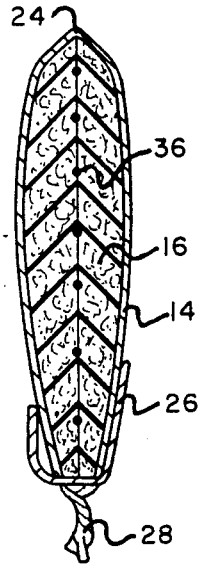
FIG. 4 is a cross-sectional view taken through the line 4—4 of FIG. 2.

As shown most clearly in FIGS. 3 and 4, the hair clamps are comprised of an outer shell 14 which is made from a substantially rigid sheet-like material such as cardboard or the like which has a substantially constant thickness throughout. Preferably, the inner and outer surfaces of the cardboard which forms the shell 14 are coated with varnish or some other substantially waterproof material. A resilient liquid absorbing liner 16 is bonded to the inner surface of the shell 14 and covers substantially the entire inner surface thereof. The liner 16 is preferably fabricated from a caustic-resistant open cell polyurethane foam.

With the liner 16 bonded to the shell 14, the two are folded over themselves along a midline 18 thereof to form front and back halves 20 and 22 having a hinged edge 24 and an open side edge. Thus, the living hinge 24 is formed from the shell and liner themselves around which the front and back halves 20 and 22 can be moved from an open position such as shown in FIG. 3 to a closed position shown in the various other figures. Depending on the thickness and rigidity of the shell 14, it may be desirable to first crease the same along the midpoint thereof to form the hinge 24. This may be done either before or after the foam liner 16 is bonded thereto.

It should be readily apparent that the inner surfaces of the front and back halves 20 and 22 form clamping surfaces between the front and back halves of the liner 16 which face each other and are compressed as the hair clamp is moved into its closed position. The hair clamp 10 or 12 can be clamped around a hank of hair and the compression force of the foam clamping surfaces holds the hair in a straightened condition. The hair clamp can be held in its closed position through the use of a U-shaped plastic closure 26 which is merely slid onto the open side edge of the clamp 10 opposite the hinge 24. The closure 26 is maintained in place by frictionally engaging the shell 14. Alternatively, a plastic coated wire twist tie 28 may be utilized to close the hair clamp 12. The twist tie 28 is previously mounted onto the outer surface of the shell 14 by stapling or glueing the same thereto with the free ends of the twist tie extending past the free edges of the shell 14 as shown most clearly in FIG. 3.

Figure 2:
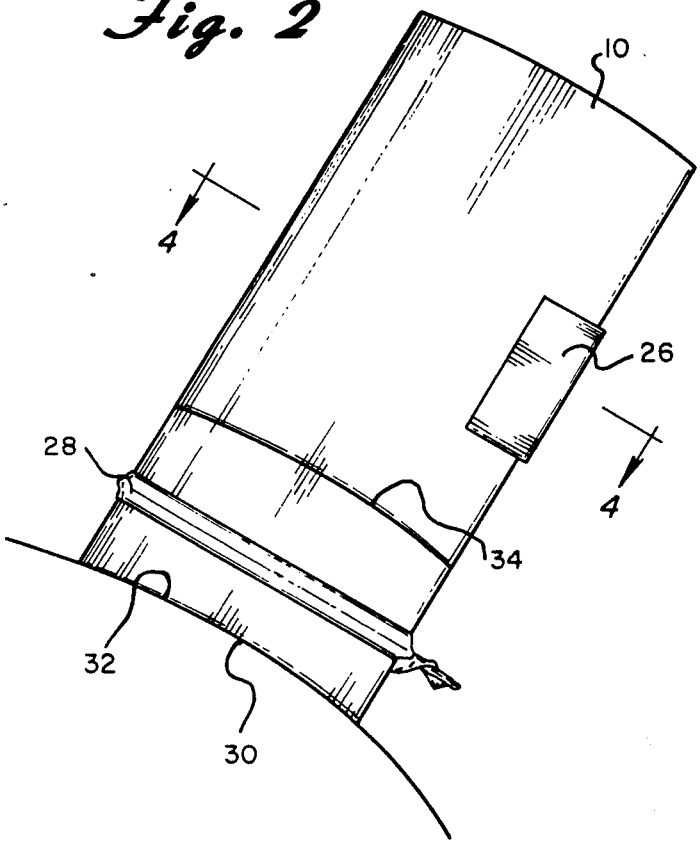
FIG. 2 is a front view of two hair clamps nested one on top of the other.

Although the outer configuration of the hair clamp as shown in FIG. 2 is substantially rectangular in shape, the bottom edge 30 is somewhat concave. This concave edge allows the clamp to be positioned very close to the person's scalp since it is complementary to the convex shape of the person's head as shown at 32 in FIG. 2. The upper end of each hair clamp is convexly shaped such as shown at 34 and is complementary to the concave shape of the lower end of each hair clamp. This allows the hair clamps to be stacked one on top of the other in an end to end relationship as shown in FIG. 2 with no space left in between.

The hair clamps of the present invention may be of substantially any convenient size. In the preferred embodiment, however, the clamps are approximately two inches wide and have heights of one and one-half inches, three inches or six inches. Preferably the foam liner has a thickness of one-quarter inch in its natural uncompressed state. When the hair clamp is closed and the foam is thereby compressed, the overall thickness of the clamp is approximately three-eighths inch.

As should be readily apparent to those skilled in the art, the hair clamps 10 and 12 can be used for a wide variety of hair treating purposes. They are, however, particularly useful for straightening hair. As a hair straightener, the clamps are used in the following manner. A hank of hair to be straightened is manually tensioned. A quantity of a known hair relaxing solution is then applied directly to the hair and/or to the foam liner 16. The clamp, in its open position, is then aligned so that the concave bottom overlies the person's head and the hair extends through the height of the foam pad. The two halves 20 and 22 are then closed and are clamped into the closed position by the use of clasp 26 or by twisting the ends of the twist tie 28 each of which is attached to the open side edge as shown in FIGS. 2 and 4.

When the two halves 20 and 22 are in the clamped position, the two halves of the foam liner 16 are compressed against each other and, therefore, maintain the hair in the straight position in which it was held before the clamp 10 or 12 was closed. FIG. 4 illustrates a plurality of strands of hair 36 clamped between the two halves of the foam liner 16. After sufficient time has elapsed to provide sufficient depolymerization of the hair protein, the clamps are removed by simply pulling them off the hair lengthwise and the hair is then washed with a shampoo which contains a neutralizer. The used clamps are then disposed of.

The present invention may be embodied in other specific forms without departing from the spirit or essential attributes thereof and accordingly reference should be made to the appended claims rather than to the foregoing specification as indicating the scope of the invention.

I claim:

1. A hair clamp comprising:

an outer shell comprised of a substantially rigid sheet-like material of substantially constant thickness throughout;

a resilient liquid absorbing liner bonded to substantially the entire inner surface of said outer shell;

said outer shell and liner being folded over themselves along a midline thereof to form front and back halves having a hinged edge and an open side edge, with the front and back halves of said liner facing each other and forming a clamping surface for holding a hank of hair therebetween;

means attached to said open side edge for maintaining said front and back halves in a folded and clamping condition;

the outer configuration of said clamp having a concave bottom and a convex top so that the bottom of said clamp can fit the contour of a person's scalp and whereby the top thereof can fit within the concave bottom of a similarly constructed clamp.

2. A hair clamp as claimed in claim 1 wherein said outer shell is substantially waterproof.

3. The hair clamp as claimed in claim 1 wherein said outer shell is comprised of cardboard.

4. The hair clamp as claimed in claim 3 wherein said cardboard outer shell is covered with a waterproof material.

5. The hair clamp as claimed in claim 1 wherein said resilient liquid absorbing liner is comprised of a synthetic foam material.

6. The hair clamp as claimed in claim 5 wherein said synthetic foam material is polyurethane foam.

7. The hair clamp as claimed in claim 1 wherein said means for maintaining said front and back halves in a folded and clamped condition is comprised of a U-shaped clip inserted over the edge of said folded outer shell and liner.

8. The hair clamp as claimed in claim 1 wherein said means for maintaining said front and back halves in a folded and clamped condition is comprised of a plastic coated twist tie.

9. The hair clamp as claimed in claim 8 wherein said twist tie is normally secured to said outer shell.

* * * * *